US006621235B2

(12) United States Patent
Chang

(10) Patent No.: US 6,621,235 B2
(45) Date of Patent: Sep. 16, 2003

(54) INTEGRATED LED DRIVING DEVICE WITH CURRENT SHARING FOR MULTIPLE LED STRINGS

(75) Inventor: Chin Chang, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 151 days.

(21) Appl. No.: 09/922,211

(22) Filed: Aug. 3, 2001

(65) Prior Publication Data

US 2003/0025120 A1 Feb. 6, 2003

(51) Int. Cl.[7] ..... H05B 37/02

(52) U.S. Cl. ..... 315/216; 315/194; 315/297; 315/291; 315/315; 315/312; 363/89; 363/21.09; 362/800

(58) Field of Search ..... 315/193, 194, 315/195, 185 R, 216, 224, 297, 300, 302, 307, 309, 312, 315, 362; 362/227, 236, 800, 806; 363/80, 89, 21.01, 21.09, 21.1, 23

(56) References Cited

U.S. PATENT DOCUMENTS 5,495,147 A * 2/1996 Lanzisera ..... 315/185 S
5,661,645 A * 8/1997 Hochstein ..... 363/89
6,285,140 B1 * 9/2001 Ruxton ..... 315/312
6,362,578 B1 * 3/2002 Swanson et al. ..... 315/307
6,369,525 B1 * 4/2002 Chang et al. ..... 315/300

FOREIGN PATENT DOCUMENTS

DE 4326282 A1 2/1995
DE 19950135 A 4/2001

* cited by examiner

*Primary Examiner*—Haissa Philogene

(57) ABSTRACT

An integrated LED driving device for multiple LED strings which employs a single linear regulator or other controller and a multiple-output current mirror which is almost independent of the DC input voltage source, almost independent of the transistor's or MOSFET's variations from the semiconductor integration process, and almost independent of temperature variation. The multiple-output current mirror includes a plurality of transistors or MOSFETs each of which are integrated on the same substrate, with identical width-to-length channel ratios and with identical source and gate connections. The integrated LED driving device provides for automatic current sharing in a DC mode and, alternately, with minimized phase delays in a PWM mode. The mirror-output current mirror may include mirror-cascode transistor pairs.

15 Claims, 4 Drawing Sheets

INTEGRATED LED DRIVING DEVICE WITH CURRENT SHARING FOR MULTIPLE LED STRINGS

FIELD OF THE INVENTION

This invention relates to light-emitting diode (LED) drivers, and more particularly to an integrated LED driving device with current sharing for multiple LED strings in a DC mode and, alternately, with minimized phase delays in a PWM mode.

BACKGROUND OF THE INVENTION

Driving large scale LED drivers for a large amount N of LED strings (such as, without limitation, in LC-TV direct backlight) requires complex circuitry and expensive controllers. Moreover, with existing technology, when the multiple LED strings are operated in a PWM mode, time delay variations are present between the controllers, which could cause different phases among the N LED strings.

Referring now to FIG. 1, a schematic diagram of a conventional LED driving device 1 for a single LED string 8 is shown and includes a simple linear regulator 5. Preferably, the LED string is driven with a specified constant current source which follows a constant reference current signal $I_{ref}$ at terminal 2*a* and a regulated DC input voltage source (NOT SHOWN), which delivers the DC input voltage $V_{DC}$ at terminal 3. The linear regulator 5 functions in a manner which maintains a constant LED current $I_{LED}$. The general operation of the linear regulator 5 will now be described in detail below.

The LED current $I_{LED}$ is sensed via a sensing resistor R28. Operational amplifier (OP-AMP) U1 in combination with resistors R25 and R26 provides proper amplification so that the LED current $I_{LED}$ information is fed back to the negative or inverting terminal of the OP-AMP U2, the regulator's controller. Resistor R25 is a feedback resistor coupled between the output terminal and the negative or inverting terminal of OP-AMP U1. Resistor R26 is coupled to the negative or inverting terminal of OP-AMP U1 and ground. The transfer function of OP-AMP U2 is expressed as $$\frac{R22}{R23}\frac{1}{1+sR22C9} \qquad \text{Eq. (1)}$$

wherein s is a complex variable; resistor R22 is a feedback resistor coupled between the output terminal and the negative or inverting terminal of OP-AMP U2; capacitor C9 is coupled in parallel with the feedback resistor R22; and resistor R23 has one terminal coupled to the negative or inverting terminal of OP-AMP U2 and the other terminal coupled to node A. The positive or non-inverting terminal of OP-AMP U2 receives the constant reference current signal $I_{ref}$ from terminal 2*a*.

Referring still to the schematic diagram, node A of the linear regulator 5 also has one terminal of resistor R21 coupled thereto and is adjacent to node B. The other terminal of resistor R21 is coupled to the drain of transistor or metal-oxide semiconductor field-effect transistor (MOSFET) QA1. The gate of transistor or MOSFET QA1 receives the constant reference current $I_{ref}$ from terminal 2*b*. The source of transistor or MOSFET QA1 is coupled to ground. Node B has coupled thereto one terminal of capacitor C8 and the cathode terminal of diode D8. The other terminal of the capacitor C8 is coupled to ground. The anode of diode D8 is coupled to the output terminal of OP-AMP U1.

A control output is generated at the output terminal of OP-AMP U2, the regulator's controller, and is coupled to the gate of transistor or MOSFET Q1 via a RC lowpass filter 6 thereby providing the gate voltage $V_{GS}$ to the transistor or MOSFET Q1. The RC lowpass filter 6 comprises resistor R24 and capacitor C10. The first terminal of resistor R24 is coupled to the output terminal of OP-AMP U2 and to a first terminal of capacitor C10. The second terminal of capacitor C10 is coupled to ground.

The linear regulator 5 further includes resistor R20 having one terminal coupled to the second terminal of resistor R24 and to the drain of transistor or MOSFET QA2. The gate of transistor or MOSFET QA2 is coupled to the output terminal of NOT gate NG3 and the source of transistor or MOSFET QA2 is coupled to ground. The input terminal of NOT gate NG3 receives the constant reference current $I_{ref}$ from the terminal 2*b*.

In operation, the drain-source current of transistor or MOSFET Q1, which is equal to $I_{LED}$, is regulated to follow the constant reference current $I_{ref}$. The linear regulator 5 in FIG. 1 works very well for a DC or a pulse-width modulated (PWM) operated LED string 8. However, when N LED strings, wherein each string includes a plurality of LEDs, are to be driven, simple duplication of the circuitry in FIG. 1 is commonly used in order to achieve equal current sharing among the N LED strings. As can be appreciated, this increases the complexity of the circuitry and controller costs of the linear regulator. Moreover, if the LED strings are operated in a PWM mode, time delay variations between the duplicated controllers and linear regulators could cause different phases among the N LED strings.

SUMMARY OF THE INVENTION

An integrated LED driving device for multiple LED strings with automatic current sharing in a DC mode and, alternately, with minimized phase delays in a PWM mode. The integrated LED driving device employs a single linear regulator or other controller for controlling a reference current and a multiple-output current mirror, which includes a plurality of transistors or MOSFETs. Each of transistors or MOSFETs are integrated on the same substrate, with almost identical width-to-length channel ratios and with identical source and gate connections. Thereby, the multiple-output mirror provides for current sharing which is almost independent of the DC input voltage source, which provides the DC input voltage $V_{DC}$, independent of the MOSFET's variation from the semiconductor integration process, and almost independent of temperature variation.

DETAILED DESCRIPTION OF THE INVENTION

Figure 1:
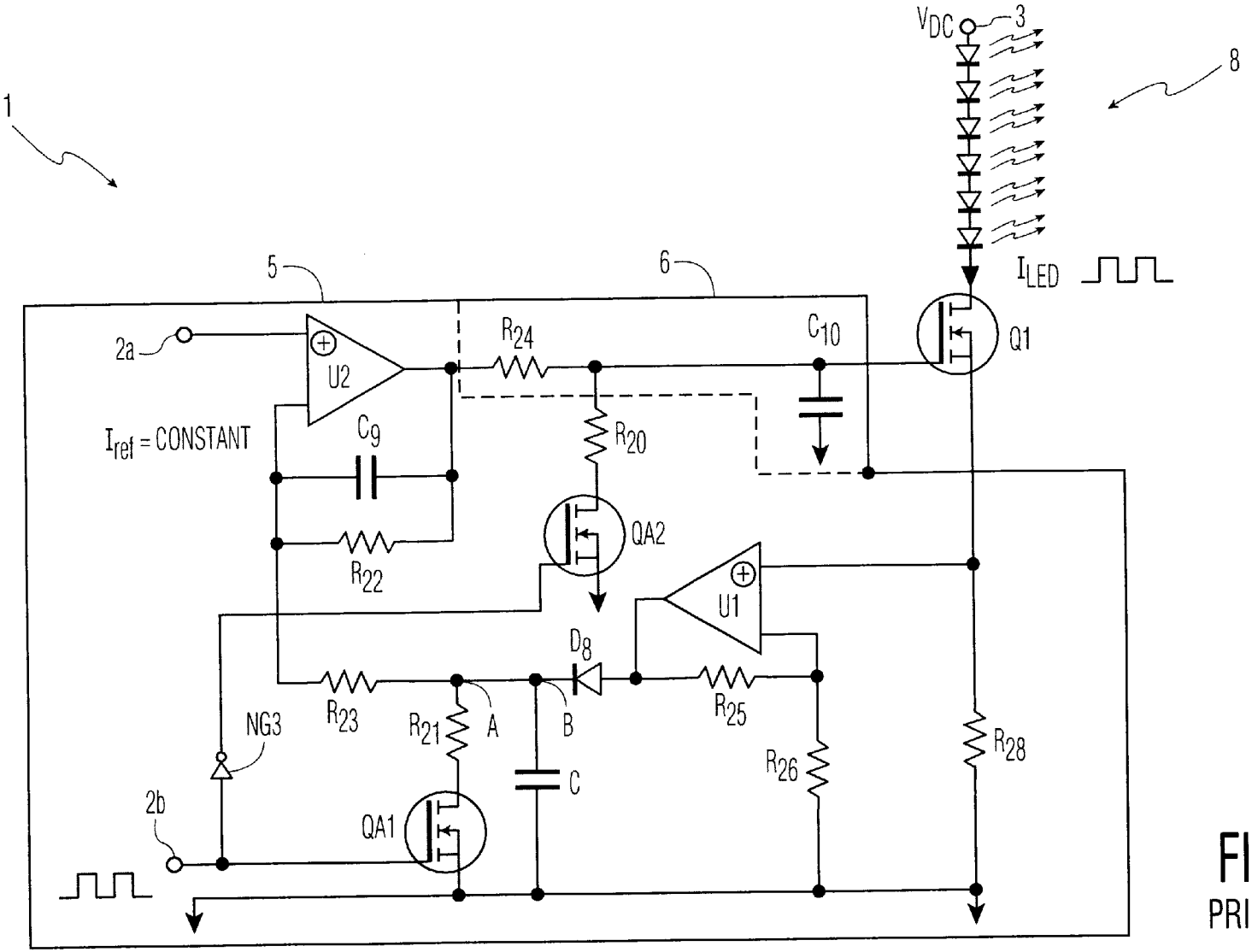
FIG. 1 PRIOR ART
FIG. 1 illustrates a schematic diagram of a conventional LED driving device for a single LED string.
Figure 2:
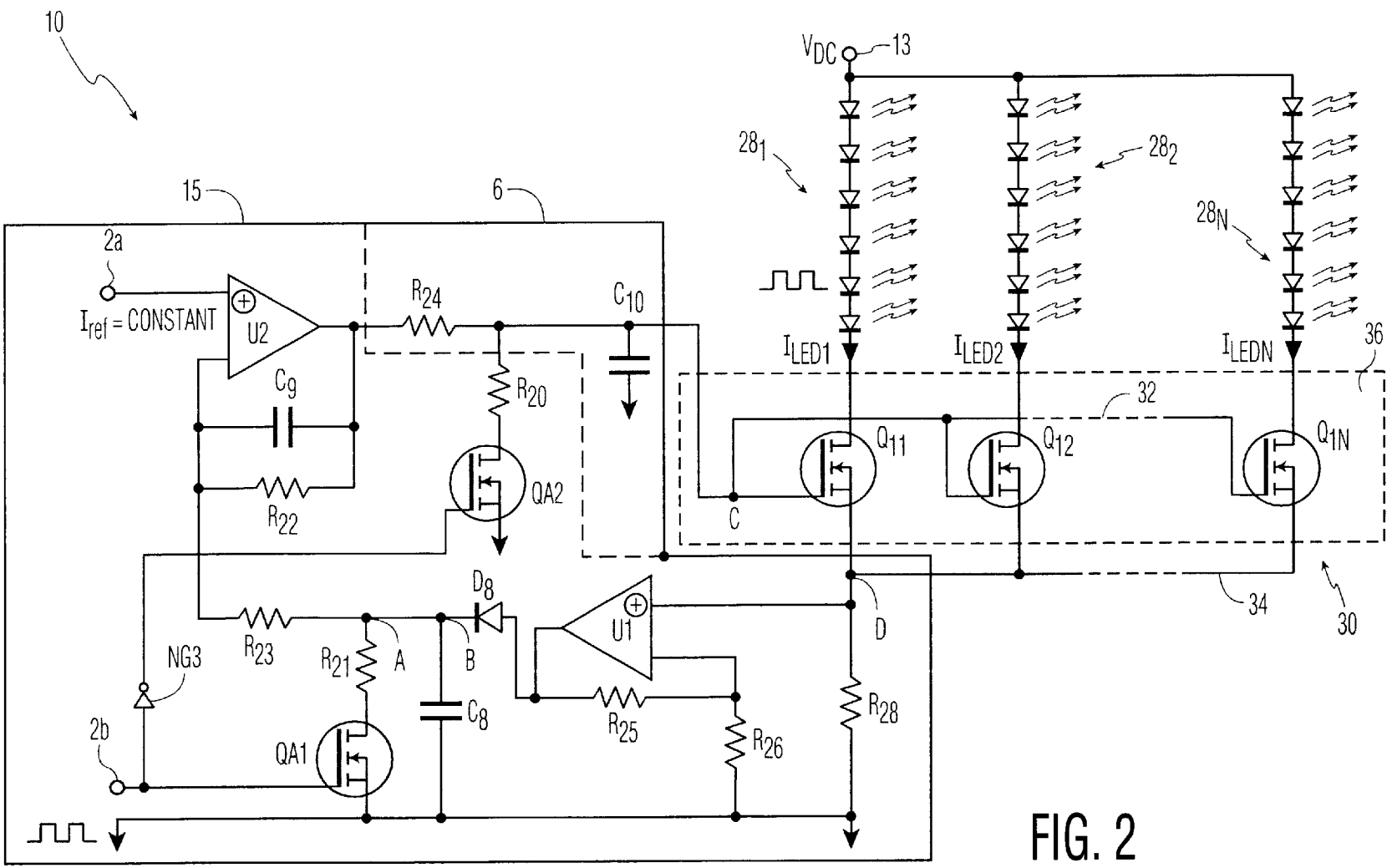
FIG. 2 illustrates a schematic diagram of an integrated LED driving device for multiple LED strings of the present invention.

Referring now to FIG. 2, an exemplary embodiment of the schematic diagram of an integrated LED driving device 10 for N LED strings $28_1, 28_2, \ldots, 28_N$ according to the present invention is shown. The integrated LED driving device 10 includes a single linear regulator 15 driven with a constant reference current signal $I_{ref}$ at terminal 2*a* and a multiple-output current mirror 30 for driving the N LED strings $28_1, 28_2, \ldots, 28_N$. Each LED string includes a plurality of LEDs. The single linear regulator 15 is essentially identical to the linear regulator 5 of FIG. 1 and thus the same reference numerals have been used. Nevertheless, other linear regulators may be employed.

Referring now to the multiple-output current mirror 30, the multiple-output mirror 30 includes N-mirror transistors or MOSFETs Q11, Q12, . . . , Q1N each of which are integrated on the same substrate 36 with preferably the same size and with identical width-to-length channel (W/L) ratios. The gates of transistor or MOSFET Q11, transistor or MOSFET Q12, . . . and transistor or MOSFET Q1N are coupled together via path 32. Path 32 extends from node C in close proximity to the gate of the first transistor or MOSFET Q11 to the gate of the $N^{th}$ transistor or MOSFET Q1N and receives the output of the lowpass filter 6 of the linear regulator 15. Thereby, each of the gates of the N-mirror transistors or MOSFETs Q11, Q12, . . . , Q1N receive the same control output from OP-AMP U2, the regulator's controller. Path 32 and node C are integrated on the substrate 36. The sources of transistor or MOSFET Q11, transistor or MOSFET Q12, . . . and transistor or MOSFET Q1N are tied together via path 34 wherein path 34 is coupled to the sensing resistor R28 of the linear regulator 15 so that current sensing resistor R28 senses the current therefrom. Each drain of the N-mirror transistors or MOSFETs Q11, Q12, . . . , Q1N is coupled to one end of a respective one of the N LED strings $28_1, 28_2, \ldots, 28_N$. In other words, the drain of first transistor or MOSFET Q11 is coupled to one end of the first LED string $28_1$, the drain of the second transistor or MOSFET Q12 is coupled to one end of the second LED string $28_2$, so on and so forth, until the drain of the $N^{th}$ transistor or MOSFET Q1N is coupled to the $N^{th}$ LED string $28_N$. The other end of each of the N LED strings $28_1, 28_2, \ldots, 28_N$ receives a DC input voltage $V_{DC}$ at terminal 13.

Referring now to the operation of the integrated LED driving device 10, since the N-mirror transistors or MOSFETs Q11, Q12 and Q1N are integrated on the same substrate 36 using the same semiconductor manufacturing process (e.g., temperature, material, mask, doping, etching) when the N-mirror transistors or MOSFETs Q11, Q12 and Q1N are operated in the saturation mode with $V_{DS} \geqq V_{GS}\ V_T$, the current flowing through the channel almost no longer depends on the drain-source voltage $V_{DS}$. $V_{GS}$ is the gate-to-source voltage and $V_T$ is the threshold level voltage. The drain current is controlled by the gate-to-source (gate) voltage $V_{GS}$ via the equation (2) wherein $I_D$ is representative of the transfer characteristic in the saturation region where $V_{DS} \geqq V_{GS} - V_T$ and is expressed by $$I_D = FCo\frac{W}{L}(V_{GS} - V_T)^2 \qquad \text{Eq. (2)}$$

where F is the mobility of the electrons; Co is the oxide capacitance per unit area; L is the channel length; and W is the channel width.

Since, the N-mirror transistors or MOSFETs Q11, Q12 and Q1N are integrated on the same substrate 36 with the same process, receive the same gate control signal from node C and have the same source connection to the linear regulator 15 at node D, the drain currents, which are equivalent to their respective one of the N LED string currents $I_{LED1}, I_{LED2}, \ldots, I_{LEDN}$, are scaled by the transistor or MOSFET size (the W/L ratio) and are expressed as $$I_{LED1}:I_{LED2}:\ldots:I_{LEDN}=(W/L)_1:(W/L)_2:\ldots:(W/L)_N \qquad \text{Eq. (3)}$$

In view of the foregoing, since the N-mirror transistors or MOSFETs Q11, Q12, . . . , Q1N are integrated with the same size (W/L ratio), the multiple-output current mirror 30 creates a current mirror effect which is used to generate automatic current sharing which is almost independent of the DC input voltage source providing voltage $V_{DC}$, almost independent of the MOSFET's variation from the semiconductor integration process, and almost independent of temperature variation.

Figure 3:
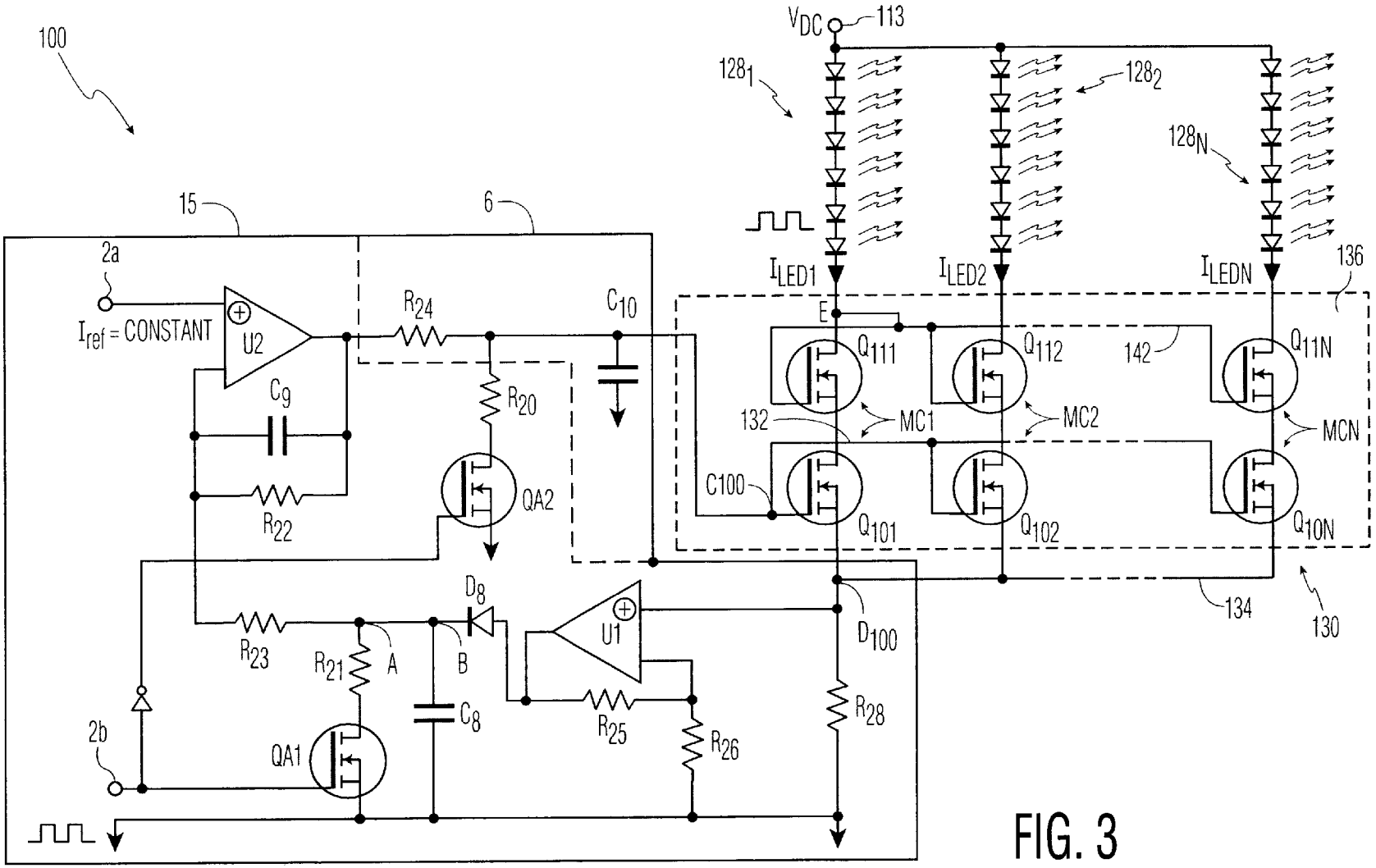
FIG. 3 illustrates a schematic diagram of an alternate embodiment of the integrated LED driving device for multiple LED strings of the present invention

Referring now to FIG. 3, the schematic diagram of an alternate embodiment of an integrated LED driving device 100 for N-LED strings $128_1, 128_2, \ldots, 128_N$ according to the present invention is shown. In general, the integrated LED driving device 100 includes a multiple-output cascode current mirror 130 for driving the N-LED strings $128_1, 128_2, \ldots, 128_N$ in lieu of the multiple-output current mirror 30, of the embodiment of FIG. 2, to improve the output impedance of the current mirrors which delivers the almost constant current.

Referring now to the multiple-output cascode current mirror 130, the multiple-output cascode current mirror 130 includes N-mirror transistors or MOSFETs Q101, Q102, . . . , Q10N and N-cascode transistors or MOSFETs Q111, 112, . . . , Q11N each of which are integrated on the same substrate 136 preferably with the same size and with identical width-to-length channel (W/L) ratios. The gates of transistor or MOSFET Q101, transistor or MOSFET Q102, . . . , and transistor or MOSFET Q10N are coupled together via path 132. Path 132 extends from node C100 in close proximity to the gate of the first-mirror transistor or MOSFET Q101 to the gate of the $N^{th}$-mirror transistor or MOSFET Q10N and receives the output of the lowpass filter 6 of the linear regulator 15. Thereby, each of the gates of the N-mirror transistors or MOSFETs Q101, Q102, . . . , Q10N receive the same control output. Path 132 and node C100 are integrated on the substrate 136. The sources of transistor or MOSFET Q101, transistor or MOSFET Q102, . . . and transistor or MOSFET Q10N are tied together via path 134 wherein path 134 is coupled to the sensing resistor R28 of the linear regulator 15 so that current sensing resistor R28 senses the current therefrom. Each drain of the N-mirror transistors or MOSFETs Q101, Q102, . . . , Q10N is coupled to one end of a respective one of the N LED strings $128_1, 128_2, \ldots, 128_N$ via a respective one of the N-cascode transistors or MOSFETs Q111, Q112, . . . , Q11N.

Referring now to the N-casode transistors or MOSFETs Q111, Q112, . . . , Q11N, the gates of transistor or MOSFET Q111, transistor or MOSFET Q112, . . . and transistor or MOSFET Q11N are coupled together via path 142. Path 142 is coupled to path 144, which connects to the drain current of the first-cascode transistor or MOSFET Q111 at node E to such gates to provide the gate voltage $V_{GS}$. The drain current of the first-cascode transistor or MOSFET Q111 is equivalent to the first LED string current $I_{LED1}$. Thereby, each gate of the N-cascode transistors or MOSFETs Q111, Q112, . . . , Q11N receive the same control signal. Path 142, path 144 and node E are integrated on the substrate 136.

Each drain of the N-cascode transistors or MOSFETs Q111, Q112, . . . , Q11N is coupled to one end of a respective one of the N LED strings $281_1, 128_2, \ldots, 128_N$. In other words, the drain of first-cascode transistor or MOSFET Q111 is coupled to one end of the first LED string $128_1$, the drain of the second-cascode transistor or MOSFET Q112 is coupled to one end of the second LED string $128_2$, so on and so forth, until the drain of the $N^{th}$ transistor or MOSFET Q11N is coupled to the $N^{th}$ LED string $128_N$. The other end of each if the N LED strings $128_1$, $128_2$, . . . , $128_N$ receives a regulated DC input voltage $V_{DC}$ at terminal 113. The sources of the N-cascode transistors or MOSFETs Q111, Q112, . . . , Q11N are coupled to a respective drain of the N-mirror transistors or MOSFETs Q101, Q102, . . . , Q10N.

Since the N-mirror transistors or MOSFETs Q101, Q102 . . . , Q10N and the N-cascode transistors or MOSFETs Q111, Q112, . . . , Q11N are integrated on the same substrate 136 with the same process and with the same size (W/L ratio) and wherein the each mirror-cascode transistor or MOSFET pair MC1, MC2, . . . , MCN have the same source and gate connections, the multiple-output cascode current mirror 130 creates a current mirror effect which is used to generate automatic current sharing which is almost independent of the DC input voltage source $V_{DC}$, almost independent of the MOSFET's variation from the semiconductor integration process, and almost independent of temperature variation while also improving the output impedance of the constant current mirror which delivers the constant current in the LEDs.

Figure 4:
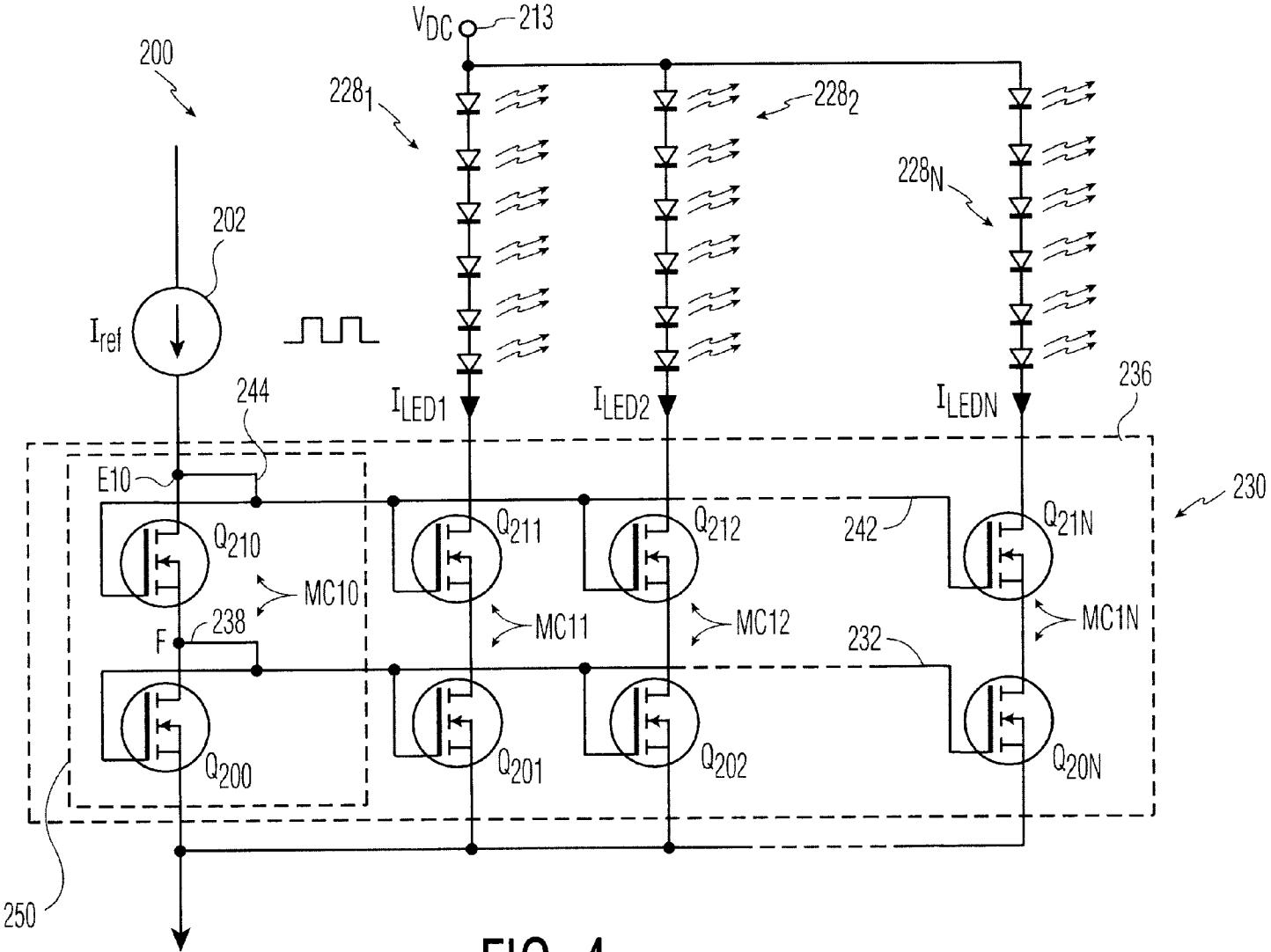
FIG. 4 illustrates a schematic diagram of an another alternate embodiment of the integrated LED driving device for multiple LED strings of the present invention.

Referring now to FIG. 4, the schematic diagram of a second alternate embodiment of an integrated LED driving device 200 for N-LED strings $228_1$, $228_2$, . . . , $228_N$ according to the present invention is shown. The integrated LED driving device 100 substitutes a mirror-cascode transistor or MOSFET pair MC10 (Q200, Q210) for the linear regulator 15 and integrates the mirror-cascode transistor or MOSFET pair MC10 on the same substrate 236, but with a different W/L ratio as the mirror-cascode transistor or MOSFET pairs MC11, MC12, . . . , MC1N. The mirror-cascode transistor or MOSFET pair MC10 (Q200, Q210) functions as a current controller or regulator 250 which receives the constant reference current $I_{ref}$ from the constant current source 202.

Referring now to the multiple-output cascode current mirror 230, the multiple-output cascode current mirror 230 includes N-mirror transistors or MOSFETs Q201, Q202, . . . , Q20N and N-cascode transistors or MOSFETs Q211, 212, . . . , Q21N each of which are integrated on the same substrate 236 with the same size preferably and identical width-to-length channel (W/L) ratios. The gates of transistor or MOSFET Q201, transistor or MOSFET Q202, . . . and transistor or MOSFET Q20N are coupled together via path 232. Path 232 is coupled to path 238, which connects to the gates of the N-mirror transistors or MOSFETs Q201, Q202, . . . , Q20N and the gate of mirror transistor or MOSFET 200 to the source of the cascode transistor or MOSFET Q210, of the current controller or regulator 250, at node F. Thereby, each of such gates receive the same control signal. Each source of the N-mirror transistors or MOSFETs Q201, Q202, . . . , Q20N and the source of mirror transistor or MOSFET 200 are coupled to ground. Each drain of the N-mirror transistors or MOSFETs Q201, Q202, . . . , Q20N and the drain of mirror transistor or MOSFET 200 is coupled to a respective source of the N-cascode transistors or MOSFETs Q211, 212, . . . , Q21N and the source of the cascode transistor or MOSFET Q210, respectively. Paths 232, 238 and node F are integrated on the same substrate 236.

Referring now to the N-cascode transistors or MOSFETs Q211, Q212, . . . , Q21N, the gates of transistor or MOSFET Q211, transistor or MOSFET Q212, . . . and transistor or MOSFET Q21N are coupled together via path 242. Path 242 is coupled to path 244, which connects to the constant reference current $I_{ref}$ or the drain current of the cascode transistor or MOSFET Q210 at node E10 to such gates. Thereby, each gate of the N-cascode transistors or MOSFETs Q211, Q212, . . . , Q21N receive the same control signal. Path 242, path 244 and node E10 are integrated on the substrate 236. Each drain of the N-cascode transistors or MOSFETs Q211, Q212, . . . , Q21N is coupled to one end of a respective one of the N LED strings $228_1$, $228_2$, . . . , $228_N$. The other end of each of the N LED strings $228_1$, $228_2$, . . . , $228_N$ receives a regulated DC input voltage $V_{DC}$ at terminal 213. The sources of the N-cascode transistors or MOSFETs Q211, Q212, . . . , Q21N are coupled to a respective one of the drains of the N-mirror transistors or MOSFETs Q201, Q202, . . . , Q20N. The drain of the cascode transistor or MOSFET Q210 is coupled to constant reference current source 202 and receives the constant reference current source $I_{ref}$.

In operation, since the N mirror-cascode transistor or MOSFET pairs MC11, MC12, . . . , MC1N of the multiple-output current mirror 230 and the mirror-cascode transistor or MOSFET pair MC10 (Q200, Q210) of the current controller or regulator 250 are integrated on the same substrate 236 with the same process, and have the same source and gate connections, the drain currents, which are equivalent to their respective one of the N LED string currents $I_{LED1}$, $I_{LED2}$, . . . , $I_{LEDN}$, are scaled by the transistor or MOSFET size (the W/L ratio) and provide a current mirror gain k which is expressed as $$I_{ref}:I_{LED1}:I_{LED2}: \ldots :I_{LEDN}=1:k:k: \ldots :k \qquad \text{Eq. (4)}$$

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed is:

1. An LED driving device for driving N LED strings, comprising:

a linear current regulator having a means for sensing current and a controller having an output control signal; and, a multiple-output current mirror including a node for receiving said output control signal, N-mirror transistors each having a gate coupled to said node, a drain coupled to a respective one of the N LED strings, a source coupled to the current sensing means and a width-to-length channel (W/L) ratio wherein the N-mirror transistors are integrated on a single substrate and have substantially identical W/L ratios.

2. The device according to claim 1, wherein the multiple-output current mirror further comprises:

N-cascode transistors each having a source coupled to a respective drain of the N-mirror transistors to form N mirror-cascode transistor pairs and wherein:

each transistor of the N-cascode transistors has a drain coupled directly to the respective one of the N LED strings;

the N-cascode transistors have substantially identical W/L ratios which are also substantially identical to the W/L ratio of the N-mirror transistors; and, the N-cascode are integrated on the single substrate.

3. The device according to claim 2, wherein the gates of the N-cascode transistors are coupled to a first LED string of the N LED strings.

4. The device according to claim 3, wherein the multiple-output current mirror provides automatic current sharing in which is almost independent of temperature variation and almost independent of transistor variation.

5. The device according to claim 1, further comprising a DC input voltage coupled to the N LED strings, wherein the multiple-output current mirror provides automatic current sharing in a DC mode and, alternately, with minimized phase delays in a PWM mode.

6. The device according to claim 5, wherein the multiple-output current mirror provides automatic current sharing which is almost independent of temperature variation, DC input voltage variation and transistor variation.

7. An LED driving device for driving N LED strings, comprising:

means for regulating a reference current signal; and a multiple-output current mirror coupled to N LED strings, the current mirror having N-mirror transistors and being coupled to the regulating means, wherein the N-mirror transistors are integrated on a single substrate with substantially identical width-to-length channel (W/L) ratios, with substantially identical gate control signals, and with substantially identical source connections.

8. The device according to claim 7, wherein the regulating means comprises a linear current regulator having a means for sensing current and a controller for producing an output control signal to a node integrated on the substrate, and wherein gates of the N-mirror transistors are coupled to the node.

9. The device according to claim 8, wherein the multiple-output current mirror further comprises N-cascode transistors each having a source coupled to a drain of a respective one of the N-mirror transistors to form N mirror-cascode transistor pairs, and wherein:

each one of the N-cascode transistors has a drain coupled directly to the respective one of the N LED strings;

each gate of the N-cascode transistors is connected to a drain of a first cascode transistor of the N-cascode transistors;

each one of the N-cascode transistors have substantially identical W/L ratios which are also substantially identical to the W/L ratios of the N-mirror transistors; and, the N-cascode transistors are integrated on the single substrate.

10. The device according to claim 7, wherein the multiple-output current mirror further comprises:

N-cascode transistors each having a source coupled to a drain of a respective one of the N-mirror transistors to form N mirror-cascode transistor pairs, wherein each transistor of the N-cascode transistors has a drain coupled directly to the respective one of the N LED strings;

each one of the N-cascode transistor have substantially identical W/L ratios which are also substantially identical to the W/L ratios of the N-mirror transistors; and the N-cascode transistors are integrated on the single substrate.

11. The device according to claim 10, wherein the regulating means includes:

a mirror transistor integrated on the single substrate, the mirror transistor having a gate control signal and a source connection which are substantially identical to the gate control signals and the source connections of the N-mirror transistors and having a second W/L ratio, wherein the W/L ratio of the N-mirror transistors are k times greater than the second W/L ratio; and, a cascode transistor integrated on the single substrate, the cascade transistor having a gate control signal which is substantially identical to the gate control signals of the N-cascode transistors and having a second W/L ratio, wherein the second W/L ratio of the cascode transistor is equal to the W/L ratio of the mirror transistor.

12. The device according to claim 11, wherein:

the sources of the N-mirror transistors are coupled to ground:

the gates of the N-mirror transistors are coupled to a path which is coupled to the drain of the mirror transistor of the regulating means.

13. The device according to claim 12, wherein the multiple-output current mirror provides automatic current sharing which is almost independent of temperature variation and almost independent of transistor variation.

14. The device according to claim 7, wherein the multiple-output current mirror provides automatic current sharing in a DC mode with minimized phase delays in a PWM mode.

15. The device according to claim 7, further comprising a DC input voltage coupled to the N LED strings, wherein the multiple-output current mirror provides automatic current sharing which is almost independent of temperature variation, the DC input voltage variation and transistor variation.

* * * * *